US007022471B2

(12) United States Patent
Ohnuma

(10) Patent No.: US 7,022,471 B2
(45) Date of Patent: Apr. 4, 2006

(54) ORGANIC SILVER SALT DISPERSION AND PRODUCTION METHOD THEREOF, PHOTOTHERMOGRAPHIC MATERIAL AND PRODUCTION METHOD THEREOF

(75) Inventor: Kenji Ohnuma, Hino (JP)

(73) Assignee: Konica Minolta Medical & Graphic Inc., Tokyo (JP)

( * ) Notice: Subject to any disclaimer, the term of this patent is extended or adjusted under 35 U.S.C. 154(b) by 40 days.

(21) Appl. No.: 10/922,017

(22) Filed: Aug. 19, 2004

(65) Prior Publication Data

US 2005/0048423 A1 Mar. 3, 2005

(30) Foreign Application Priority Data

Aug. 29, 2003 (JP) ..... 2003-306270

(51) Int. Cl.
*G03C 1/00* (2006.01)

(52) U.S. Cl. ..... 430/617; 430/618; 430/619; 430/620; 430/567; 430/531; 430/536; 430/523; 430/527; 430/631

(58) Field of Classification Search ..... 430/617, 430/567, 618, 620, 619, 531, 536, 523, 527, 430/631

See application file for complete search history.

(56) References Cited

U.S. PATENT DOCUMENTS

| | | | | |
|---|---|---|---|---|
| 3,960,908 | A | 6/1976 | Ikenoue et al. | |
| 4,273,723 | A | 6/1981 | Hayashi et al. | |
| 2004/0166449 | A1* | 8/2004 | Miyake | 430/536 |
| 2004/0180301 | A1* | 9/2004 | Nakagawa | 430/531 |

FOREIGN PATENT DOCUMENTS

| | | |
|---|---|---|
| EP | 1 270 608 A1 | 1/2003 |
| EP | 04 02 0070 | 10/2004 |
| GB | 1498406 | 1/1978 |
| JP | 2001-312024 | 11/2001 |
| JP | 2003-114491 | 4/2003 |

* cited by examiner

*Primary Examiner*—Geraldine Letscher
(74) *Attorney, Agent, or Firm*—Lucas & Mercanti LLP

(57) ABSTRACT

An organic silver salt dispersion containing: light-insensitive organic silver salt grains; photosensitive silver halide grains; a solvent; and a binder for dispersion, wherein the organic silver salt is prepared by using: (i) an alkaline metal salt of an organic acid other than a sodium salt; and (ii) a water soluble silver compound, and the binder is a polyvinyl acetal resin having a polymerization degree of 250 to 1000 and prepared by acetal forming reaction of a polyvinylalcohol with an aldehyde.

9 Claims, No Drawings

ORGANIC SILVER SALT DISPERSION AND PRODUCTION METHOD THEREOF, PHOTOTHERMOGRAPHIC MATERIAL AND PRODUCTION METHOD THEREOF

TECHNICAL FIELD

The present invention relates to an organic silver salt dispersion and the production method thereof, as well as a photothermographic material and the production method thereof.

BACKGROUND

In recent years, in the medical field, as an output means of diagnostic images such as X-ray CT and MRI, an image forming method has been employed in which exposure is performed by scanning laser beams onto photosensitive materials. Thus, these photosensitive materials are subjected to image exposure by scanning laser beams. Thereafter, image exposed materials are processed employing a wet photographic processing and employed for diagnosis.

When photosensitive materials are subjected to wet processing, effluent has resulted in problems in view of environmental protection. In recent years, additionally, in view of space saving, it has been strongly demanded to reduce the amount of spent processing effluent.

Consequently, techniques related to photothermographic materials have been sought which can be efficiently exposed employing a laser imager, and can also form clear black images at high resolution.

As described, for example, in U.S. Pat. Nos. 3,152,904 and 3,487,075, and D. Morgan, "Dry Silver Photographic Materials" (Handbook of Imaging Materials, Marcel Dekker, Inc., page 48, 1991), known as realization of such techniques are photothermographic materials which comprise a support having thereon organic silver salts, photosensitive silver halide grains and reducing agents.

Listed as essential constituting components in the aforesaid photothermographic materials and thermally developable materials are organic silver salts. Organic silver salts are insoluble in organic solvents. Consequently, when they are employed as a photosensitive material, it is required to coat a dispersion, which is prepared by dispersing organic silver salts containing silver halides into dispersing binders having layer forming property. Specifically employed as the most suitable binders having layer forming property are polyvinyl acetal resins. However, commonly available polyvinyl acetal resins are comprised of various compositions. Further, due to the production methods, a small amount of impurities are incorporated. Such impurities occasionally result in degradation of image characteristics after coating such as fog formation, poor image tone, or insufficient storage stability of unexposed film.

In order to overcome the above-mentioned drawbacks, addition of components such as antifoggants or toners, which improve photographic image characteristic, is knows in the art. Patent Documents 1 and 2 disclose that it is also possible to perform improvements depending on compositions and characteristics of binders in photosensitive materials.

However, in the case in which the methods described in the above-mentioned Patent Documents 1 and 2 were employed, image characteristics were improved. However, it was discovered that other problems occurred in which the particle size distribution of dispersed organic silver salt particles was broadened and silver halides readily aggregated, whereby the maximum density of the resulting photosensitive materials became insufficient.

It is ideal that in photothermographic materials, photosensitive silver halides as a photocatalyst, reducible organic silver salts, and thermally activated reducing agents are arranged in a desired balance in a coating. In order to achieve the more desired image characteristics, a more desired organic silver salt dispersion and the production method thereof are needed. Uniformly arranging the organic silver salts may be performed by enhancing dispersibility of the organic silver salts. The inventors of the present invention paid close attention to the production process of organic silver salts and investigated ways of improving dispersibility. As a result, it was discovered that it was possible to prepare organic silver salts of a relatively small particle diameter, which especially exhibited desired dispersibility. Patent Documents 3 and 4 describe organic silver salts comprised of sodium salts or potassium salts. However, the inventors of the present invention discovered that by improving both organic silver salts and dispersing binders, it was possible to prepare an organic silver salt dispersion which exhibited better dispersibility than that by methods known in the prior art, and a photothermographic material which exhibited excellent image characteristics.

(Patent Document 1) JP-A No. 2000-235242
(Patent Document 2) JP-A No. 2002-355543
(Patent Document 3) JP-A No. 5-53239
(Patent Document 4) JP-A No. 8-234358

SUMMARY

The present invention was achieved to solve the aforesaid problems. An object of the present invention is to provide an organic silver salt dispersion prepared by dispersing a raw material liquid composition comprising at least an organic silver salt, photosensitive silver halide grains, a solvent, and a dispersing binder, and the production method thereof, as well as a photothermographic material exhibiting image characteristics of low fogging and high density which is prepared employing an organic dispersion exhibiting the preferred dispersibility ant the production method thereof.

An object of the present invention can be achieved by the following embodiment.

An embodiment of the present invention includes an organic silver salt dispersion containing:

light-insensitive organic silver salt grains;
photosensitive silver halide grains;
a solvent; and
a binder for dispersion,
wherein the organic silver salt is prepared by using:
(i) an alkaline metal salt of an organic acid other than a sodium salt; and
(ii) a water soluble silver compound, and
the binder is a polyvinyl acetal resin having a low polymerization degree and prepared by acetal forming reaction of a polyvinylalcohol with an aldehyde.

According to the present invention, it is possible to provide a production method of an organic silver salt dispersion exhibiting excellent dispersibility and a photothermographic material having image characteristics such as lower fog and high density.

DESCRIPTION OF THE PREFERRED EMBODIMENTS

The present invention will now be detailed. Preferred embodiments of the present invention are as follows.

(1) An organic silver salt dispersion comprising:
light-insensitive organic silver salt grains;
photosensitive silver halide grains;
a solvent; and
a binder for dispersion,
wherein the organic silver salt is prepared by using:
(i) an alkaline metal salt of an organic acid other than a sodium salt; and
(ii) a water soluble silver compound, and
the binder is a polyvinyl acetal resin having a polymerization degree of 250 to 1000 and prepared by acetal forming reaction of a polyvinylalcohol with an aldehyde.

(2) The organic silver salt dispersion of Item 1,
wherein an average particle diameter of the organic silver salt grains is 50 to 600 nm.

(3) The organic silver salt dispersion of Item 1,
wherein the alkaline metal salt of the organic acid is a potassium salt, a magnesium salt or a calcium salt.

(4) The organic silver salt dispersion of any one of Items 1 to 3,
wherein a water content A (%) in the light-insensitive organic silver salt grains and a water content B (%) in the binder for dispersion satisfy the formula:

$$0.05 \leqq A+B \leqq 5$$

(5) A method of producing an organic silver salt dispersion comprising the step of:
dispersing a mixture of:
light-insensitive organic silver salt grains;
photosensitive silver halide grains;
a solvent; and
a binder for dispersion,
wherein the organic silver salt is prepared by using:
(i) an alkaline metal salt of an organic acid other than a sodium salt; and
(ii) a water soluble silver compound, and
the binder is a polyvinyl acetal resin having a polymerization degree of 250 to 1000 and prepared by acetal forming reaction of a polyvinylalcohol with an aldehyde.

(6) A method of producing an organic silver salt dispersion comprising the step of:
dispersing a mixture of:
light-insensitive organic silver salt grains;
photosensitive silver halide grains;
a solvent; and
a binder for dispersion,
wherein an average particle diameter of the organic silver salt grains is 50 to 600 nm; and
the binder is a polyvinyl acetal resin having a polymerization degree of 250 to 1000 and prepared by acetal forming reaction of a polyvinylalcohol with an aldehyde.

(7) The method of producing an organic silver salt dispersion of Item 5,
wherein an average particle diameter of the organic silver salt grains is 50 to 600 nm. (8) The method of producing an organic silver salt dispersion of Item 5,
wherein the alkaline metal salt of the organic acid is a potassium salt, a magnesium salt or a calcium salt.

(9) The method of producing an organic silver salt dispersion of any one of Items 5 to 8,
wherein a water content A (%) in the light-insensitive organic silver salt grains and a water content B (%) in the binder for dispersion satisfy the formula:

$$0.05 \leqq A+B \leqq 5$$

(10) A photothermographic material comprising a support having thereon a photosensitive layer containing the organic silver salt dispersion of any one of Items 1 to 4 and an additional amount of the binder.

The aforesaid "an additional amount of the binder" indicates another portion of the binder added to make the photosensitive layer.

(11) The photothermographic material of Item 10,
wherein an amount of the binder for dispersion is 1/50 to 1/5 of a total weight of the binder in the photosensitive layer.

The aforesaid "a total weight of the binder" is a sum of the weight of the binder for dispersion and the binder added to make the photosensitive layer.

(12) A method of producing a photothermographic material, comprising the step of:
coating the organic silver salt dispersion of any one of Items 1 to 4 with an additional amount of the binder on the support to obtain the photosensitive layer; and
drying the coated photosensitive layer.

(13) The method of producing a photothermographic material of Item 12,
wherein an amount of the binder for dispersion is 1/50 to 1/5 of a total weight of the binder in the photosensitive layer.

Incidentally, in the following description, organic silver of non-photosensitive organic silver salts is simply called organic silver or an organic silver salt.

It is preferable that polyvinyl acetal resins in the range of a degree of polymerization of 250–1,000 are employed as the dispersing binders of the present invention. Polyvinyl acetal resins at a degree of polymerization of at most 250 are not preferred, since such polyvinyl acetal resins easily absorb moisture and when employed in photosensitive materials, moisture, which results in fogging, is also brought into the dispersion. On the other hand, use of polyvinyl acetal resins having a degree of polymerization of at least 1,000, is not preferred since the viscosity of a law material liquid composition excessively increases, whereby insufficient dispersion, poor conveyance of liquid compositions and insufficient mixing occur.

Polyvinyl acetal resins employed as the dispersing binders of the present invention are synthesized via an acetalation reaction (or acetal forming reaction) of polyvinyl alcohol with various types of aldehydes, and preferred are those which have undergone acetalation with butyl aldehyde and/or acetaldehyde. The amount of the acetalated portion of polyvinyl acetal resins is preferably in the range of 60–100 percent and is more preferably at least 85 percent. Not preferred is the portion acetalated by aldehydes which is at most 60 percent, since the resulting polyvinyl acetal resins easily absorb moisture and when employed in photothermographic materials, since such polyvinyl acetal resins easily absorb moisture, moisture which results in fogging is brought into the dispersion.

Employed as aldehydes may be any aldehyde such as formaldehyde, acetaldehyde, butylaldehyde, or propylaldehyde which is capable of undergoing acetalation. In the case of the present invention, it is preferable that butyl aldehyde is singly employed, or butylaldehyde and acetaldehyde are employed in combination.

Non-photosensitive organic silver salts employed in the organic silver salt dispersion of the present invention are reducible silver sources, and are preferably silver salts of organic acids and heteroorganic acids containing reducible silver ion sources. Especially, preferred are aliphatic carboxylic acids having a long chain (10–30 carbon atoms, and preferably 15–25 carbon atoms) and nitrogen-containing heterocyclic rings are preferred. Organic or inorganic silver complexes are also useful in which the ligand has a general stability constant of 4.0–10.0 with respect to the silver ions.

Examples of suitable silver salts are described in Research Disclosure Items 17029 and 29963, and include salts of organic acids (e.g., salts of gallic acid, oxalic acid, behenic acid, arachidic acid, stearic acid, palmitic acid, and lauric acid); carboxyalkylthiourea salts of silver (e.g., 1-(3-carboxypropyl)thiourea and 1-(3-carboxypropyl)-3,3-dimethylthiourea); silver complexes of polymer reaction products of aldehydes and hydroxy-substituted aromatic carboxylic acids (e.g., aldehydes (such as formaldehyde, acetaldehyde, or butylaldehyde) and hydroxy-substituted acids (e.g., salicylic acid, benzoic acid, and 3,5-dihydroxybenzoic acid, and 5,5-thiodisalicylic acid); silver salts or complexes of thiones (e.g., 3-(2-carboxyethyl)-4-hydroxymethyl-4-(thiazoline-2-thione) and 3-carboxymethyl-4-thiazoline-2-thione); complexes or salts of nitrogen acids selected from imidazole, pyrazole, urazole, 1,2,4-thiazole and 1H-tetrazole, 3-amino-5-benzylthio-1,2,4-triazole, and benzotriazole with silver; silver salts of saccharin and 5-chlorosalicylaldoxime; and silver salts of mercaptan derivatives. Preferred silver sources are silver behenate, silver arachidate and/or silver stearate.

Organic silver salt compounds are prepared by mixing water-soluble silver compounds and compounds forming complexes with silver. When mixed, preferably employed are a normal mixing method, a reverse mixing method, or a double-jet mixing method. Further, it is possible to use the controlled double-jet method as described in JP-A No. 9-127643. Specifically, alkaline metal salts are added to organic acids and an organic acid alkaline metal salt soap is prepared. Thereafter, silver nitrate is added to the aforesaid soap, whereby crystals of organic silver salts are prepared. During the aforesaid operation, silver halide grains may be present. In the series of the above reaction processes, by employing suitable stirring members, it is necessary to sufficiently stir so all the mixture in the reaction vessel becomes uniform.

Alkaline metal salts are usable in the present invention, except for sodium salts. Specific examples include lithium hydroxide, potassium hydroxide, magnesium hydroxide, aluminum hydroxide, cesium hydroxide, calcium hydroxide, and barium hydroxide. Of these, when effects to photothermographic materials are taken into account, preferred are potassium hydroxide, magnesium hydroxide, and calcium hydroxide.

Organic acid alkaline metal salt soap, formed employing these metal salts, forms a micelle structure in water. Since the atomic radii of the aforesaid metals are larger than that of sodium, it is possible to increase the size of the formed micelle structure. As the micelle radius increases, the distance between adjacent soap structures increases. As a result, it is possible to retard aggregation of organic silver salt crystals formed by the addition of silver nitrate and thereby decrease the size of the secondary particles.

In the present invention, it is preferable that the organic silver salts are dehydrated and dried. Suction funnels and centrifugal dehydrators are preferably employed for dehydration, while hot air circulation dryers and airborne driers are preferably employed for drying. In the present invention, it is preferable that organic silver salts comprise primary particles of an average diameter of at most 1 μm, and are monodipsersed. The average primary particle diameter of organic silver salts, as described herein, refers to the diameter of a sphere which has the same volume as the organic silver salt particle, when it is spherical, rod-shaped, or tabular.

In the present invention, however, excluded from the measurement of primary particles are secondary particles which are formed by aggregation of organic silver salt particles, as well as aggregates which are formed through combinations of organic silver salt particles with photosensitive silver halides and dispersing binders.

In the present invention, the average diameter of the primary particles of organic silver salts is preferably 50–600 nm, and is most preferably 50–400 nm. Further monodispersion, as described herein, is as defined for silver halide, and the degree of monodispersion is preferably 1–30. In the present invention, it is more preferable that organic silver salts are comprised of monodipsersed particles of an average diameter of the primary particles of at most 1 μm. By controlling the organic silver salts in this range, it is possible to produce images at the desired high density. Further, it is preferable that the ratio of tabular particles of organic silver salts is at lest 60 percent with respect to all the organic silver. Tabular particles, as described in the present invention, refers to those in which the ratio of the average particle diameter to the thickness, or the so-called aspect ratio (hereinafter referred to as AR), represented by the formula below, is at least 3. AR=average particle diameter (in μm)/thickness (in μm)

Methods to prepare organic silver salt particles having the aforesaid shape are not particularly limited. However it is preferable to optimize various kinds of conditions such as the mixing state during formation of an organic acid alkaline metal soap and/or the mixing state during addition of silver nitrate to the aforesaid soap. In order to minimize devitrification of the photothermographic material of the present invention, the total amount of photosensitive silver halides and organic silver salts is preferably at most 2.2 $g/m^2$ in terms of the silver amount, and is more preferably 0.5–2.2 $g/m^2$.

In view of fogging and storage stability of photothermographic materials, the preferred state is that the organic silver salt dispersion employed in the present invention comprises the least possible amount of water. In order to realize the foregoing, it is required that organic silver salts containing photosensitive silver halide grains which are brought into the dispersion are sufficiently dried, whereby moisture absorption of dispersing binders is lowered. In the present invention, it is preferable that the sum of A and B is 0.05–5 wherein A (in percent) represents the moisture content of the organic silver salts and B (in percent) represents the moisture content of the dispensing binders. When the sum exceeds 5, moisture which is brought into the organic silver salt dispersion becomes excessive. On the other hand, a sum of 0.05 or less is not preferred since developability of photothermographic materials is degraded resulting in a decrease in maximum density.

Listed as solvents incorporated into the organic silver salt dispersion of the present invention are, for example, ketones such as acetone, isophorone, ethyl amyl ketone, methyl ethyl ketone, or methyl isobutyl ketone; alcohols such as methyl alcohol, ethyl alcohol, n-propyl alcohol, isopropyl alcohol, n-butyl alcohol, isobutyl alcohol, diacetone alcohol, cyclohexanol, or benzyl alcohol; glycols such as ethylene glycol, diethylene glycol, triethylene glycol, propylene glycol, or hexylene glycol; ether alcohols such as ethylene glycol monomethyl ether and diethylene glycol monomethyl; and ethers such as ethyl ether, dioxane, or isopropyl ether. It is preferable that these solvents contain no water.

Listed as esters are ethyl acetate, butyl acetate, amyl acetate, and propyl acetate. Listed as hydrocarbons are n-pentane, n-hexane, n-heptane, cyclohexane, benzene, toluene and xylene. Listed as chlorides are methyl chloride, methylene chloride, chloroform, and dichlorobenzene.

Listed as amines are monomethylamine, dimethylamine, triethanolamine, ethylenediamine, and triethylamine. Listed as others are, but are not limited to, water, formamide, dimethylformamide, nitromethane, pyridine, toluidine, tetrahydrofuran, and acetic acid. Further, solvents are employed singly or in combinations of several types.

It is preferable that the organic silver salt dispersion of the present invention is prepared as follows. Organic silver salt particles, photosensitive silver halide grains, and dispersing binders, which are incorporated, are preliminary dispersed in the presence of surface active agents, if desired, and subsequently, the resulting dispersion is subjected to dispersion and pulverization (being main dispersion), employing a media homogenizer or a high pressure homogenizer. For the aforesaid preliminary dispersion, employed may be common anchor type or propeller type stirrers, a high speed rotation centrifugal radial stirrer (being a dissolver), a high speed rotation shearing type stirrer (being a homomixer).

The amount of binders employed in the aforesaid preliminary dispersion and main dispersion is preferably in the range of 0.1–10 percent by weight with respect to the organic silver salts. Further, it is preferable to control temperature during dispersion. Specifically, it is also preferable that the temperature does not exceed 30° C. during the preliminary dispersion and main dispersion. A rise of temperature of the dispersion during dispersion is not preferred because the fog density of the finished photothermographic material occasionally increases.

When an amount of an organic acid included in the organic silver salt is known, it is preferred that the amount of binders for dispersion is changed in accordance therewith. In that case, the amount of the binder for dispersion is preferably in the range of 50 to 150 weight % based on the organic acid included in the organic silver salt. The amount of the binder is more preferably in the range of 70 to 110 weight %.

When the amount of the binder is less than 50 weight %, the viscosity of the dispersed composition may become too high during the preliminary dispersion process. It may result in difficulty for transportation of the preliminary dispersion to carry out the main dispersion process.

The aforesaid phenomenon is known as thixotropy observed when the solubility of an organic acid to a solution of polyvinyl acetal is too low. In the present invention, such kind of failure in physical property is improved by employing a polyvinyl acetal having a predetermined range of a polymerization degree as mentioned above.

In addition, when the amount of the binder is larger than 150 weight %, the dispersion efficiency may become too poor during the main dispersion process. This would cause a larger size in an average particle diameter of the obtained organic silver salt dispersion, or the particle size distribution may become larger. These are the results contrary to the objects of the present invention.

Employed as the aforesaid media homogenizers may be tumbling mills such as a ball mill, a planetary ball mill, or a vibration ball mill, medium stirring mills such as a bead mill or an attritor, and another such as a basket mill. Employed as high pressure homogenizers may be various types such as a type in which liquid is subjected to collision with the walls or plugs, a type in which liquid is separated into several portions and separated liquid portions are collided with each other, and a type in which liquid is passed through narrow orifices.

Materials which are preferably employed for the aforesaid bead mill are ceramic beads. Preferably employed as the aforesaid materials are, for example, $Al_2O_3$, $BaTiO_3$, $SrTiO_3$ (strontium titanate), MgO, ZrO, BeO, $Cr_2O_3$, $SiO_3$, $SiO_2$-$Al_2O_3$, $Cr_2O_3$—MgO, MgO—CaO, MgO—C, MgO—$Al_2O_3$ (spinel), SiC, $TiO_2$, $K_2O$, $Na_2O$, BaO, PbO, $B_2O_3$, $BeAl_2O_4$, $Y_3Al_5O_{12}$, $ZrO_2$—$Y_2O_3$ (cubic crystalline zirconia), 3BeO—$Al_2O_3$—$6SiO_2$ (synthetic emerald), C (synthetic diamond), $SiO_2$-$nH_2O$, silicon nitride, yttrium-stabilized zirconia, and zirconia-reinforced alumina.

In the present invention, due to the reason that formation of impurities through friction with beads and homogenizers, yttrium-stabilized zirconia (hereinafter referred to as zirconia) and zirconia-reinforced alumina are particularly preferably employed. In apparatuses which are employed to produce the photosensitive emulsion of the present invention, preferably employed as materials of the members which come into contact with incorporated organic silver salt particles and photosensitive silver halide grains are ceramics such as zirconia, alumina, silicon nitride, boron nitride and/or diamond. In view of enhancement of dispersibility of organic silver salt particles and photosensitive silver halide, zirconia is particularly preferably employed.

In the case of using zirconia during dispersion, the amount of Zr (being zirconium as a metal) incorporated in the photosensitive emulsion of the present invention is preferably 0.01–0.5 mg per g of silver contained in the aforesaid emulsion, and is most preferably 0.01–0.3 mg. In order to prepare photosensitive emulsions of the desired dispersibility for the photosensitive layer (being the image forming layer) of photothermographic materials according to the present invention, it is highly preferable to optimize the concentration of dispersing binders, the preliminary dispersion method, homogenizer operating conditions, and the dispersion frequency during the aforesaid dispersion.

Employed as high pressure homogenizers employed in the present invention may be, for instance, Nanomizer LA-31 (manufactured by Nanomizer Co.), Microfluidizer (manufactured by Microfluidics Co.), and Gaulin Homogenizer (manufactured by APV Co.).

In the present invention, by performing dispersion in such a manner that pressure variation during dispersion is controlled within at most 50 percent of the predetermined maximum pressure, it is possible to prepare organic silver salt dispersion exhibiting the desired dispersibility. In order to more achieve the desired dispersibility, the pressure variation-value is preferably within 30 percent, and is more preferably with in 20 percent.

Further, by performing dispersion in such a manner that within at least 90 percent of the time, for which the aforesaid raw material liquid composition is being dispersed, pressure variation during dispersion is controlled within at most 30 percent of the predetermined maximum pressure, it is more possible to prepare organic silver salt dispersion having the desired dispersibility.

The maximum processing pressure employed in the present invention is preferably at least 100 kgf/cm$^2$, and is more preferably at least 280 kgf/cm$^2$.

Methods to decrease the pressure variation (specifically means ejection pressure variation) of high pressure homogenizers employed in the present invention are not particularly limited. However, a decrease in the pressure variation is realized employing a method utilizing an accumulator (pressure storage), a method in which a plurality of pumps is arranged during shifting of the phase, and combinations thereof.

Further, in the case in which a raw material liquid composition, comprised of organic silver salts, photosensitive silver halide grains, solvents, and binders, is dispersed employing the high pressure homogenizer used in the present invention, if desired, temperature of the liquid composition to be dispersed may be controlled. Temperature of the stock liquid composition prior to dispersion may be controlled in a tank in which the aforesaid stock liquid composition is placed, or between the tank and the dispersion performing section of the high pressure homogenizer. Specifically, when cooling is performed below the dew point, cooling the composition in the tank results in problems such as dew formation. Consequently, it is preferable that the sealed flow channel from the tank to the dispersion performing section is cooled.

The photothermographic material of the present invention is prepared as follows. Additives such as the reducing agents described below are added to the organic silver salt dispersion prepared by the use of the present invention. In order to retain these components in a coating, the resulting mixture is applied onto a support employing layer forming binders (hereinafter, in order to differentiate from dispersing binders, these will be described as coating binders). Such coating binders are employed in such an amount range that they effectively function as a binding material (also called a binder), together with dispersing binders.

For example, in the photosensitive layer (being the image forming layer), as an index of holding at least organic silver salts, the ratio of the total binders to the organic silver salts is preferably in the range of 15:1–1:2, and is more preferably in the range of 8:1–1:1. Namely, the total binder amount of the image forming layer is preferably 1.5–6 g/m$^2$, and is more preferably 1.7–5 g m$^2$. When the total binder amount is less than 1.5 g/m$^2$, the image forming layer is occasionally not viable due to an excessive increase in density of unexposed areas.

In addition, it is preferable that coating binders are added to the organic silver salt dispersion so that the amount of the coating binders increases more than the amount of the dispersing binders. The amount of the dispersing binders employed during dispersion is particularly preferably in the range of 1/50–1/5 with respect to the total binders incorporated in the photosensitive material. When the amount is at most 1/50, dispersibility of organic silver salts during dispersion is degraded. On the other hand, when it is at least 1/5, dispersibility of organic silver salt dispersion during coating is degraded. In both cases, coatability is degraded during coating. Even though the quality of the finished coating is visually acceptable, non-uniformity of developed silver results in mottling to degrade images.

Suitable coating binders for the photothermographic material of the present invention are transparent or translucent, and commonly colorless. Listed as these binders are natural polymers, synthetic resins, polymers, copolymers and other such film forming media, for example, described in [0069] of JP-A No. 2001-330918. Of these, coating binders which are suitable for the photosensitive layer of the photothermographic material of the present invention are polyvinyl acetals. Further, for a top coating layer and a base coating layer, especially non-photosensitive layers such as a protective layer or a back coat layer, preferred are cellulose esters, which are polymers having a higher softening temperature, being especially polymers such as triacetylcellulose or cellulose acetate butyrate. Incidentally, if desired, the aforesaid binders may be employed in combinations of at least two types.

Glass transition temperature Tg of coating binders employed in the present invention is preferably 70–105° C. Use of binders having a Tg of 70–105° C. is preferred since a sufficient maximum density is obtained when images are formed. It is possible to determine Tg through measurements employing a differential scanning calorimeter. The intersection point of the base line and the slope of the endothermic peak is designated as the glass transition point.

In the present invention, glass transition point (Tg) is determined employing the method described on pages III-139–III-179 of "Polymer Handbook" by Brandlap et al. (published by Wiely & Son, 1966).

In the case in which a binder is a copolymer resin, Tg is obtained by the formula below.

$$Tg\ (\text{copolymer})\ (^\circ\ \text{C.})=v_1Tg_1+v_2Tg_2+\ldots+v_nTg_n$$

wherein $v_1$, $v_2$ . . . $v_n$ each represent the mass fraction of a monomer in the copolymer, and $Tg_1$, $Tg_2$ . . . $Tg_n$ each represent Tg (° C.) of a homopolymer prepared by each monomer in the copolymer.

Accuracy of Tg calculated by the above formula is ±5° C.

Photosensitive silver halide grains employed in the present invention function as a photosensor. In the present invention, in order to minimize haze after image formation, as well as to achieve excellent image quality, it is preferable that the average primary grain size of photosensitive silver halide grains is rather small. The average primary grain size is preferably at most 1 μm, is more preferably 0.01–0.1 μm, and is most preferably 0.02–08 μm.

Average grain size, as described herein, refers to the diameter (being the equivalent circle diameter) of a circle having the same area as that of each grain image observed employing an electron microscope. However, the primary grain size according to the present invention does not relate to secondary grains which are formed through aggregation of photosensitive silver halides grains, as well as aggregates which are formed by aggregation of photosensitive silver halide grains with organic silver salts and binders.

Further, photosensitive silver halide grains are preferably monodipsersed. As used herein, the term "monodispersion" means that the degree of monodispersion obtained by the formula below is at most 40 percent. Grains of a degree of monodispersion of at most 30 percent are more preferred, and those of a degree of monodispersion of at most 20 percent are particularly preferred.

Degree of monodispersion (in percent)=(standard deviation of grain diameter)/(average value of grain diameter)×100

Shapes of silver halide grains are not particularly limited. It is preferable that the ratio occupied by the Miller index [100] plane is high. The ratio is preferably at least 50 percent, is more preferably at least 70 percent, and is most preferably at least 80 percent. It is possible to obtain the ratio of the Muller index [100] plane, referring to T. Tani, J. Imaging Sci., 29, 165 (1985) which utilizes adsorption dependence onto [111] and [100] planes in the adsorption of a sensitizing dye.

Another preferred shape of silver halide grains is tabular. As described herein, the term "tabular grains" refers to grains of an aspect ratio r/h of at least 3, wherein r (in μm) is the grain diameter which is the square root of the projected area and h (in μm) is the perpendicular thickness. Tabular grains of an aspect ratio of 3–50 are preferred. The grain diameter is preferably at most 0.1 μm, and is more preferably 0.01–0.08 μm. Tabular grains are described in U.S. Pat. Nos. 5,264,337, 5,314,798, and 5,320,958, whereby it is possible to easily prepare targeted tabular grains.

Halogen compositions are not particularly limited, and silver chloride, silver chlorobromide, silver chloroiodobromide, silver bromide, silver iodobromide, and silver iodide may be employed. It is possible to prepare photographic emulsions employed in the present invention, employing the methods described in P. Glafkides, Chimie et Physique Photographique (published by Paul Montel Co, 1967), G. F. Duffin, Photographic Emulsion Chemistry (published by The Focal Press, 1966), and V. L. Zelikman et al., Making and Coating Photographic Emulsion (published by The Focal Press, 1964). Namely, employed may be any of an acidic method, a neutral method, or an ammonia method. Further, employed as methods to allow soluble silver nitrate salts to react with soluble halogen salts may be any of a single-jet mixing method, a double-jet mixing method, or combinations thereof.

It is preferable that ions of metals which belong to Groups 6–11 of the periodic table are incorporated into photosensitive silver halide grains of the present invention. Preferred as the above-mentioned metals are W, Fe, Co, Ni, Cu, Ru, Rh, Pd, Re, Os, Ir, Pt, and Au. It is possible to introduce these metal ions into silver halide grains in the form of metal complexes or metal complex ions. Preferred as these metal complexes or metal complex ions are six-coordinate metal complexes represented by General Formula (1) below.

$$[ML_6]^m \qquad \text{General Formula (1)}$$

wherein M represents a transition metal selected from the elements in Groups 6–11 of the periodic table, L represents a ligand, and m represents 0, -, 2-, 3-, or 4-. Listed as specific examples of ligands represented by L are halides (e.g., fluoride, chloride, bromide, and iodide), cyanates, and each ligand of cyanato, thiocyanate, selenocyanato, tellurocyanato, azide and aquo, as well as nitrosyl and thionitrosyl. Of these, preferred are aquo, nitrosyl and thionitrosyl. When the aquo ligand is present, it is preferable that it occupies one or two ligands, while L may be the same or different.

Particularly preferred specific examples as M include rhodium (Rh), ruthenium (Ru), rhenium (Re), iridium (Ir), and osmium (Os). Specific examples of transition metal complex ions employed in the present invention will be shown below, however, the present invention is not limited thereto.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[IrCl_6]^{4-}$
7: $[Ru(NO)Cl_5]^{2-}$
8: $[RuBr_4(H_2O)]^{2-}$
9: $[Ru(NO)(H_2O)Cl_4]^{-}$
10: $[RhCl_5(H_2O)^{2-}$
11: $[Re(NO)Cl_5]^{2-}$
12: $[Re(NO)(CN)_5]^{2-}$
13: $[Re(NO)Cl(CN)_4]^{2-}$
14: $[Rh(NO)_2Cl_4]^{-}$
15: $[Rh(NO)(H_2O)Cl_4]^{-}$
16: $[Ru(NO)(CN)_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^{-}$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$
27: $[Ir(NS)Cl_5]^{2-}$

These metal ions, metal complexes, and metal complex ions may be employed individually or in combinations of at least two types of the same metal or different metals. The content of these metal ions, metal complexes, or metal complex ions is commonly $1\times10^{-9}$–$1\times10^{-2}$ mol per mol of silver halide grains, and is preferably is $1\times10^{-8}$–$1\times10^{-2}$.

It is preferable that compounds which provide these metals are added during formation of silver halide grains and are included in the silver halide grains. They may be added during any stage of preparation of silver halide grains, namely nuclei formation, growth, physical ripening, and prior to and after chemical ripening. However, it is particularly preferable that the addition is performed during the stage of nuclei formation, growth, and physical ripening. Addition during the stage of nuclei formation and growth is more preferred, and addition during the stage of nuclei formation is most preferred.

An addition composition may be divided onto several portions and each portion may be added intermittently. It is possible to achieve uniform incorporation in a silver halide grain. As described in JP-A Nos. 63-29603, 2-306236, 3-167545, 4-76534, 6-110146, and 5-273683, it is possible to achieve incorporation to make the specified distribution in the grain. It is preferable that the specified distribution is formed in the grain.

These metal compounds may be dissolved in water or suitable solvents (for example, alcohols, ethers, glycols, ketones, esters, and amides) and then added. A method exists in which either an aqueous solution of metal compound powder, or an aqueous solution in which metal compounds are dissolved together with NaCl and KCl, is added to a water-soluble silver salt solution or a water-soluble halide solution during formation of grains, a method in which when a silver salt solution and a halide solution are mixed employing a double-jet method, addition is performed using a third aqueous solution so that a triple-jet method is employed, or a method in which during preparation of silver halide grains, other silver halide grains which have been doped with metal ions or complex ions are added and dissolved. Of these, the method is preferred in which either an aqueous solution of metal compound powder, or an aqueous solution in which metal compounds are dissolved together with NaCl and KCl, is added to a water-soluble halide solution.

When added to the surface of grains, it is possible to charge an aqueous solution of metal compounds in a necessary amount into a reaction vessel immediately after grain formation, during or at the completion of physical ripening or during chemical ripening. In the present invention, light-sensitive silver halide grains may be desalted after formation of the grains. When desalted, desalting may be performed employing the washing methods known in this industry, such as the noodle method or the flocculation method.

It is preferable that light-sensitive silver halide grains employed in the present invention are chemically sensitized. Applied as preferred chemical sensitization methods are a sulfur sensitization method, a selenium sensitization method, and a tellurium sensitization method which are well known in this industry. In addition, employed may be noble metal sensitization employing gold, platinum, palladium or iridium compounds, and a reduction sensitization method.

Employed as compounds which are preferably employed for the sulfur sensitization method, selenium sensitization method and tellurium sensitization method may be the compounds known in the art, and it is possible to use the compounds described in JP-A No. 7-128768. Employed as tellurium sensitizers may be, for example, diacyl tellurides, bis(oxycarbonyl)tellurides, bis(carbamoyl)tellurides, diacyl tellurides, bis(oxycarbonyl)ditellurides, bis(carbamoyl)ditellurides, compounds having a P═Te bond, tellurocarboxylates, Te-organyltellurocarboxylic acid esters, di(poly)tellurides, tellurides, tellurols, telluroacetals, tellurosulfonates, compounds giving a P—Te bond, Te containing heterocycles, tellurocarbonyl compounds, inorganic tellurium compounds, and colloidal tellurium.

Preferably employed as compounds in the noble metal sensitization method may be, for example, chloroauric acid, potassium chloroaurate, potassium aurithiocyanate, gold sulfide, gold selenide, as well as compounds described in U.S. Pat. No. 2,448,060 and British Patent No. 618,061. Employed as specific compounds for the reduction sensitization method may be, for example, stannous chloride, aminoiminomethanesulfinic acid, hydrazine derivatives, boran compounds, silane compounds, and polyamine compounds other than ascorbic acid and thiourea dioxide. Further, by performing ripening while maintaining the pH of emulsions at 7 or more, or maintaining the pAg of the same at 8.3 or more, it is possible to perform reduction sensitization. Further, by introducing the single addition portion of silver ions during grain formation, it is possible to perform reduction sensitization.

It is preferable that reducing agents are incorporated into thermally developable (photographic) light-sensitive materials of the present invention. Examples of suitable reducing agents are described in U.S. Pat. Nos. 3,770,448, 3,773,512, and 3,593,863, and Research Disclosure Items 17029 and 29963, and include the following.

Aminohydoxycycloalkenone compounds (e.g., 2-hydroxypiperidino-2-cyclohexane); aminoreductone esters as a precursor of reducing agents (e.g., piperidinohexose reductone monoacetate); N-hydroxyurea derivatives (e.g., N-p-methylphenyl-N-hydroxyurea); hydrazones of aldehyde or ketone (e.g., anthracenealdehyde phenylhydrazone); phosphoramidophenols; phosphoramidoanilines; polyhydroxybenzenes (e.g., hydroquinone, t-butyl-hydroquinone, isopropylhydroquinone, and 2,5-dihydroxy-phenyl) methylsulfone); sulfihydroxamic acids (e.g., benzenesulfihydroxamic acid); sulfoneamidoanilines (e.g., 4-(N-methanesulgonamido)aniline); 2-tetrazolylthiohydroquinones (e.g., 2-methyl-5-(1-phenyl-5-tetrazolylthio)hydroquinone); tetrahydroquinoxalines (e.g., 1,2,3,4-tetrahydroquinoxaline); amidoxines; azines (e.g., combinations of aliphatic acid arylhydrazides and ascorbic acid); combinations of polyhydroxybenzene and hydroxylamine, reductones and/or hydrazines; hydroxamic acids; combinations of azines and sulfonamidophenols; α-cyanophenylacetic acid derivatives; combinations of bis-β-naphthol and 1,3-dihydroxybenzene derivatives; 5-pyrazilones; sulfonamidophenol reducing agents; 2-phenylindane-1,3-diones; chroman; 1,4-dihydropyridines (e.g., 2,6-dimethoxy-3,5-dicarboethoxyl,4-dihydropyridine); bisphenols (e.g., bis(2-hydroxy-3-t-butyl-5-methylphenyl)methane, bis(6-hydroxy-m-tri) mesitol, 2,2-bis(4-hydroxy-3-methyphenyl)propane, 4,5-ethylidene-bis(2-t-butyl-6-methyl)phenol), ultraviolet radiation sensitive ascorbic acid derivatives, and 3-pyrazolidones. Of these, particularly preferred reducing agents are hindered phenols.

Listed as hindered phenols are the compounds represented by General Formula (A) below.

General Formula (A)

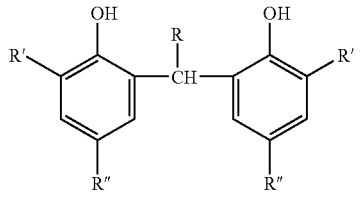

wherein R represents a hydrogen atom or an alkyl group having 1–10 carbon atoms (for example, a butyl group and a 2,4,4-trimethylpentyl group), and R' and R" each represent an alkyl group having 1–5 carbon atoms (for example, a methyl group, an ethyl group, or a t-butyl group).

Specific examples of the compounds represented by General Formula (A) are shown below, however the present invention is not limited thereto.

A-1

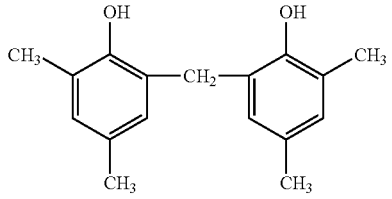

A-2

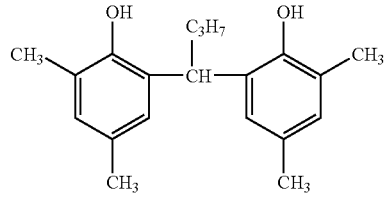

A-3

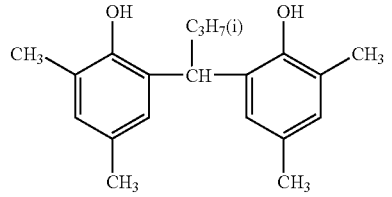

A-4

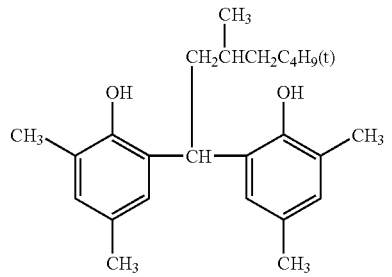

A-5

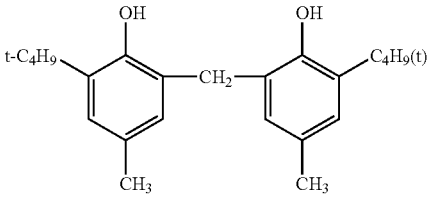

-continued

A-6

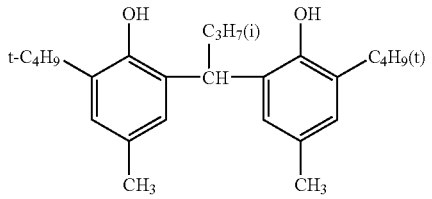

A-7

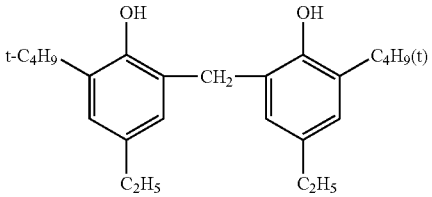

The used amount of reducing agents such as the compounds represented by aforesaid General Formula (A) and others is preferably $1\times10^{-2}$–10 mol per mol of silver, and is particularly preferably $1\times10^{-2}$–1.5 mol. Antifoggants may be incorporated into the photothermographic materials of the present invention. Those known as effective antifoggants are mercury ions. Use of mercury compounds in light-sensitive materials as an antifoggant is disclosed, for example, in U.S. Pat. No. 3,589,903. However, mercury compounds are not environmentally preferred. Consequently, in the present invention, preferably employed are mercury-free antifoggants such as those, for example, disclosed in U.S. Pat. Nos. 4,546,075 and 4,452,885.

Listed as particularly preferable mercury-free antifoggants are such as those disclosed in U.S. Pat. Nos. 3,874,946 and 4,756,999, which are heterocyclic compounds having one or more substituents represented by —C ($X_1$) ($X_2$) ($X_3$) (wherein $X_1$ and $X_2$ each represent a halogen atom and $X_3$ represents a hydrogen atom or a halogen atom).

Employed as other appropriate antifoggants may be the compounds described in paragraph Nos. [0030]–[0036] of JP-A 9-288328, the compounds described in paragraph Nos. [0062]–[0063] of JP-A No. 9-90550, and the compounds disclosed in U.S. Pat. No. 5,028,523, as well as European Patent Nos. 600,587, 605,981, and 631,176.

For the purpose of improving silver tone after development, it is preferable to add toners to the photothermographic materials of the present invention. Examples of appropriate toners are disclosed in Research Disclosure item 17029 and include the following:

Imides (e.g., phthalimide); cyclic imides; pyrazoline-5-ones and quinazoline (e.g., succinimide, 3-phenyl-2-pyrazoline-5-one, 1-phenylurazole, quinazoline and 2,4-thiazolinedione); naphthalimides (e.g., N-hydroxy-1,8-napththalimide); cobalt complexes (e.g., cobalt hexaminetrifluoroacetate); mercaptans (e.g., 3-mercapto-1,2,4-triazole); N-(aminomethyl)aryldicarboxyimides (e.g., N-(dimethylaminomethyl)phthalimide); blocked pyrazoles; isothiuronium derivatives and combinations of certain kinds of light bleaching agents (e.g., a combination of N,N-hexamethylene(1-carbamoyl-3,5-dimethylpyrazole), 1,8-(3,6-dioxaoctane)bisisothiuroniumtrifluoroacetate), and 2-(tribromomethylsulfonyl)benzothiazole; merocyanine dyes (e.g., 3-ethyl-5-((3-ethyl-2-benzothiazolynidene(benzothiazolynidene))-2-thio-2,4-oxazolizinedione); phthalazinone, phthalazinone derivatives or metal salts of derivatives thereof (e.g., 4-(1-naphthyl)phthalazinone, 6-chlorophthalazinone, 5,7-dimethyloxyphthalazinone, and 2,3-dihydro-1,4-phthalazinedione); combinations of phthalazinone and sulfinic acid derivatives (e.g., 6-chlorophthalazine and sodium benzenesulfinate or 8-methylphthalazine and sodium p-trisulfonate); a combination of phthalazine and phthalic acid; combinations of phthalazine (including phthalazine addition products) and at least one compound selected from maleic anhydride and phthalic acid, 2,3-naphthalenedicarboxylic acid, or o-phenylic acid derivatives and anhydrides thereof (e.g., phthalic acid, 4-methylphthalic acid, 4-nitrophthalic acid, and tetrachlorophthalic anhydride); quinazolidiones, benzoxazine, naphthoxazine derivatives; benzoxazine-2,4-diones (e.g., 1,3-benzoxazine-2,4-dione); pyrimidines and asymmetric triazines (e.g., 2,4-dihydroxypyrimidine) and tetraazapentalene derivatives (e.g., 3,6-dimercapto-1,4-diphenyl-1H,4H-2,3a,5,6a-tetraazapentalene). Preferred toners are phthalazone or phthalazine.

It is possible to use in the photothermographic materials of the present invention sensitizing dyes, described for example, in JP-A Nos. 63-159841, 60-140335, 63- 231437, 63-259651, 63-304242, and 63-15245, as well as U.S. Pat. Nos. 4,639,414, 4,740,455, 4,741,966, 4,751,175, and 4,835,096.

Useful sensitizing dyes employed in the present invention are described, for example, in Research Disclosure Item 176431 Section V-A (page 23, December 1978) and Item 18431 (page 437, August 1979) and references cited therein. It is possible to select useful sensitizing dyes having the spectral sensitivity which is suitable for spectral characteristics. of various types of scanner radiation sources. For example, preferably employed are the compounds described in JP-A Nos. 9-34078, 9-54409, and 9-80679.

For the purpose of controlling development in such a manner that development is retarded or accelerated, enhancing the efficiency of spectral sensitization, and improving storage stability prior to and after development, mercapto compounds, disulfide compounds, and thione compounds may be incorporated. In the case in which mercapto compounds are employed in the present invention, those having any appropriate structure may be employed. However, those represented by the following structural formula are preferred.

Ar—SM, Ar—S—S—Ar wherein M represents a hydrogen atom or an alkaline metal atom, and Ar represents an aromatic ring having at least one of a nitrogen, sulfur, oxygen, selenium or tellurium atom or a condensed aromatic ring.

Employed as the aforesaid aromatic rings are aromatic carbon rings and heterocyclic aromatic rings. In the present invention, heterocyclic aromatic rings are preferably employed. Examples of heterocyclic aromatic rings include benzimidazole, naphthimidazole, benzthiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, purine, quinoline, or quinazoline.

These heterocyclic aromatic rings may have those selected from the group consisting of substituents such as a halogen atom (e.g., Br and Cl), a hydroxyl group, an amino group, a carboxyl group, an alkyl group (e.g., having at least one carbon atom, preferably having 1–4 carbon atoms), and an alkoxy group (e.g., having at least one carbon atom, preferably having 1–4 carbon atoms). Listed as mercapto-substituted heterocyclic aromatic compounds are 2-mercaptobenzimidazole, 2-mercaptobenzoxazole, 2-mercaptobenzthiazole, 2-mercapto-5-methylbenzthiazole, 3-mercapto-1,2,4-triazole, 2-mercaptoquinoline, 8-mercaptopurine, 2,3,5,6-tetrachloro-4-pyridinethiol, 4-hydroxy-2-mercaptopyrimidine, and 2-mercapto-4-phenyloxazole, but the present invention is not limited thereto.

In the photothermographic materials of the present invention, it is preferable that matting agents are incorporated into the photosensitive layer side. Further, in order to minimize abrasion damage of images after thermal development, it is preferable to arrange matting agents on the surface of light-sensitive materials. It is preferable that the aforesaid matting agents are incorporated in an amount of 0.5–30 percent by weight with respect to the total binders on the emulsion layer side. Materials of matting agents employed in the present invention may be either organic or inorganic.

Employed as inorganic materials may be, for example, silica described in Swiss Patent No. 330,158, glass powder described in French Patent No. 1,296,995, and carbonates of alkaline earth metals or cadmium and zinc. Employed as organic materials may be organic matting agents such as starch described in U.S. Pat. No. 2,322,037, starch derivatives described in Belgian Patent No. 625,451 and British Patent No. 981,198, polyvinyl alcohol described in Japanese Patent Publication No. 44-3643, polystyrene or polymethacrylates described in Swiss Patent No. 330,158, polyacrylonitrile described in U.S. Pat. No. 3,079,257, and polycarbonate described in U.S. Pat. No. 3,022,169.

The shape of matting agent particles may be either regular or irregular. However, those which are regular or spherical are preferably employed. The size of matting agent particles is represented by the diameter of a sphere which has the same volume as each matting agent particle. The particle diameter of matting agents, as described in the present invention, refers to the aforesaid equivalent sphere diameter. The average particle diameter of matting agent employed in the present invention is preferably 0.5–10 μm, and is more preferably 1.0–8.0 μm. Further, the variation coefficient of a particle size distribution is a maximum of 50 percent, is more preferably a maximum of 40 percent, and is most preferably a maximum of 30 percent.

Herein, the variation coefficient of the particle size distribution refers to the value represented by the following formula.

(standard deviation of particle diameter)/(average value of particle diameter)×100

Matting agents employed in the present invention may be incorporated into any of the constitution layers. However, in order to achieve the objective of the present invention, the matting agents are preferably incorporated into the constitution layers other than the light-sensitive layer, and are more preferably incorporated into the outermost layer, viewed from the support.

The matting agents employed in the present invention may be added by the use of a method in which matting agents are previously dispersed into a liquid coating composition and subsequently coated, or a method in which after coating a liquid coating composition, matting agents are sprayed onto it prior to completion of drying. Further, in the case in which a plurality of matting agents is added, both methods may be simultaneously employed. In the present invention, in order to improve electrification, it is possible to incorporate electrically conductive materials such as metal oxides and/or electrically conductive polymers into the constitution layers. These materials may be incorporated into any of the layers, but may preferably be incorporated into a sublayer, a backing layer, or the layer between the light-sensitive layer and the subbing.

In the photothermographic materials of the present invention, electrically conductive materials described in columns 14–20 of U.S. Pat. No. 5,244,773 are preferably employed. Various types of additives may be incorporated into any of the photosensitive layer, the non-photosensitive layer or the other constitution layers.

Other than those described above, employed in the photothermographic materials of the present invention may be, for example, surface active agents, antioxidants, stabilizers, plasticizers, UV absorbers, and covering aids. Preferably used as these additives and other additives described above may be the compounds described in Research Disclosure Item 17029 (pages 9–15, June 1978).

A composition comprising each component of the photothermographic materials of the present invention is held by the aforesaid binders and is applied onto various types of supports selected from a wide range of materials while divided into one or more layers. Listed as components of supports may be various types of polymer materials, glass, wool fabric, cotton fabric, paper, and metal (e.g., aluminum). In view of manipulation as information recording materials, those capable of being converted to flexible sheets or rolls are suitable.

Accordingly, preferred as supports for the photothermographic materials of the present invention are plastic films (e.g., cellulose acetate film, polyester film, polyethylene terephthalate film, polyamide film, polyimide film, cellulose triacetate film or polycarbonate film). As noted above, in the present invention, particularly preferred is biaxially oriented polyethylene terephthalate film.

Methods for coating each layer of the light-sensitive materials of the present invention are not particularly limited. It is possible to employ prior art methods such as a bar coating method, a curtain coating method, a dip coating method, an air knife coating method, or a hopper coating method. A preliminary amount determining type coating system called an extrusion method is more preferred.

Further, it is preferable that the light-sensitive material of the present invention is provided with a protective layer and a back coat layer in addition to the aforesaid light-sensitive layer. Further, if desired, the light-sensitive layer may be comprised of two layes which differ in photospeed, while an interlayer may be provided between those two layers.

Binders of the protective layer are preferably water-insoluble polymers such as cellulose acetate, cellulose acetate butyrate, or polyvinyl butyral. Of these, cellulose acetate and cellulose acetate butyrate are particularly preferred.

The thickness of photothermographic layer comprising silver halide of the present invention is preferably 0.2–40 μm per layer, and is more preferably 2–30 μm.

The thickness of the surface protective layer is preferably 0.2–10 μm per layer, and is more preferably 1–5 μm.

The thickness of the back coat layer is preferably 0.2–10 μm per layer, and is more preferably 2–5 μm.

In the present invention, it is advantageous that when a photothermographic material is thermally developed, a small amount of solvents is incorporated in the material. Such solvents may be a small amount of residues which have been employed as a coating solvent, or a small amount of solvents which are separately coated employing a spray method. The presence of such solvents is preferred because thermal development characteristics are improved, resulting in higher gamma and lower fogging.

Listed as such solvents are, for example, ketones such as acetone, isophorone, ethyl amyl ketone, methyl ethyl ketone, or methyl isobutyl ketone; alcohols such as methyl alcohol, ethyl alcohol, n-propyl alcohol, isopropyl alcohol, n-butyl alcohol, isobutyl alcohol, diacetone alcohol, cyclohexanol, or benzyl alcohol; glycols such as ethylene glycol, diethylene glycol, triethylene glycol, propylene glycol, or hexylene glycol; ether alcohols such as ethylene glycol monomethyl ether or diethylene glycol monomethyl ether; ethers such as ethyl ether, dioxane, or isopropyl ether; esters such as ethyl acetate, butyl acetate, amyl acetate, or isopropyl acetate; hydrocarbons such as n-pentane, n-hexane, n-butane, cyclohexane, benzene, toluene, or xylene; chlorides such as methyl chloride, methylene chloride, chloroform, or dichlorobenzene; amines such as monomethylamine, diethylamine, triethanolamine, ethylenediamine, or triethylamine; and others such as water, formamide, dimethylformamide, nitromethane, pyridine, toluidine, tetrahydrofuran, or acetic acid. However, the present invention is not limited thereto. Further, these solvents may be employed singly or in combinations of a plurality of types.

Incidentally, the proportion of the aforesaid solvents in the light-sensitive materials may be controlled depending on variation of conditions such as a temperature in the drying process after the coating process. Further, it is possible to determine the content of the aforesaid solvents employing gas chromatography under conditions which are suitable to detect the incorporated solvents.

In the present invention, when image data are written on photothermographic materials, it is preferable that exposure is performed utilizing laser scanning. Further, it is preferable to employ a laser scanning exposure apparatus in which the angle between the exposed surface of light-sensitive materials and the scanning laser beam does not substantially become vertical.

As used herein, the term "does not substantially become vertical" means that during laser scanning, angle nearest verticality is preferably 55–88 degrees, is more preferably 60–86, is further more preferably 65–84, and is most preferably 70–82.

When light-sensitive materials are subjected to laser beam scanning, the diameter of beam spots is preferably at most 200 μm, and is more preferably at most 100 μm. A smaller spot diameter is preferred because it is possible to decrease the deviation of the laser beam incident angle from verticality. Incidentally, the lower limit of the beam spot is 10 μm. By performing such laser scanning exposure, it is possible to minimize image degradation due to reflected light resulting in such phenomenon as generation of interference fringe-shaped mottling.

Further, it is preferable that exposure in the present invention is performed employing a laser scanning exposure device which emits scanning laser beams in longitudinal multi. Compared to the laser beams in a longitudinal single mode, degradation of image quality such as formation of diffraction fringe-shaped mottling is minimized.

Longitudinal multi is preferably achieved employing a method in which returned light is utilized due to multiplication or high frequency superposition is applied. As used herein, the term "longitudinal multi" means that exposure wavelength is not single one. It is preferable that the distribution of exposure wavelength is commonly at least 5 nm, and is preferably at least 10 nm. The upper limit of the distribution of the exposure wavelength is not particularly specified, but is commonly about 60 nm.

By employing these writing means, it is possible to produce excellent images exhibiting minimal mottling and desired sharpness.

Developing conditions of the photothermographic material of the present invention vary depending on the composition and constitution of employed materials as well as the structure. However, after exposure, development is typically performed by heating the light-sensitive material to a temperature suitable for the above light-sensitive martial. A latent image formed by exposure is converted to a silver image and visualized (developed) by heating at a relatively high temperature (for example, about 80–about 250° C., and preferably about 100° C.–about 200° C.) over a sufficient period of time (commonly about one second–about two minutes). Heating may be carried out employing typical heating means such as a hot plate, an iron, a heating roller, or a heat generator employing carbon or white titanium. Of these, in view of heat efficiency and workability, a method is preferred in which thermal development is performed during conveyance while brought into contact with a heating roller.

Further, in view of heat transmission efficiency, photothermographic materials are preferably heated from the protective layer side. Doing so, it is possible to avoid problems such as non-uniform heating and prolonged time for heat transmission which are caused by heating from the support side.

Doing as noted, it is possible to produce high quality silver images only by heating.

EXAMPLES

The present invention will now be detailed with reference to examples, however the present invention is not limited thereto. Initially, evaluation methods which are common to the samples of the present invention will be described, and subsequently, methods for preparing the samples of the present invention will be described. Incidentally, photothermographic materials which have been subjected to photographic processing are designated as thermally developed recording materials.

(Evaluation Methods)

(Evaluation of Organic Silver Salt Dispersion)

After main dispersion, the resulting organic silver salt dispersion was diluted with methyl ethyl ketone to result in a solid concentration of 1 percent. The resulting liquid composition was measured employing a high concentration based probe of a high concentration based analyzer FPAR-1000, manufactured by Otsuka Electronics Co., Ltd. At an integration time of 240 seconds per measurement, the number average particle diameter (in nm) was determined employing the Marquadt Method (Lambda=1,000 and Italation=1,000). The average value of three measurements was designated as the average particle diameter (in nm) of organic silver salts in the organic silver salt dispersion.

(Density Evaluation of Thermally Developed Recording Materials)

Light-sensitive materials were subjected to wedge exposure employing a diode sensitometer fitted with 820 nm diodes. Thereafter, the exposed materials were processed (developed) at 120° C. for 15 seconds. Subsequently, each density of the fog density portions and the maximum density portions of the thermally developed recording materials, which have been photographically processed, was determined employing an optical densitometer.

(Preparation of Dispersing Binders)

(Preparation of Dispersing Binder A)

After dissolving 100 g of polyvinyl alcohol (PVA, manufactured by Kuraray Co., Ltd.) of a degree of polymerization of 500 and a saponification ratio of 99.8 percent in 900 g of distilled water, the resulting solution was maintained at 20° C., and subsequently 40 g of 35 percent hydrochloric acid and further, 17.5 g of butylaldehyde were added. Subsequently, the resulting mixture was cooled to 12 ° C., and 60.5 g of butylaldehyde was added. After deposition of a resin, the resulting composition was allowed to stand for 30 minutes. Thereafter, 110 g of 35 percent hydrochloric acid was added, and the resulting mixture was heated to 30° C. and was allowed to stand for 10 hours.

After completion of the reaction, washing was performed employing distilled water. Sodium hydroxide was added to the washed polyvinyl butyral resin dispersion, and the pH of the resulting liquid composition was adjusted to 7. The resulting liquid composition was allowed to stand at 50° C. for 12 hours and subsequently cooled. At that time, the pH of the liquid composition was 5.4. Subsequently, the liquid composition was washed with distilled water in an amount of a factor of 100 with respect to the polyvinyl butyral solid. After removing water, distilled water in an amount of a factored of 10 was added and the resulting liquid composition was maintained at 50° C. while stirring. Thereafter, the resulting composition was dehydrated and dried at 40° C. until the weight variation per hour reached a maximum of 0.1 percent.

(Preparation of Dispersing Binder B)

Dispersing Binder B was prepared in the same manner as aforesaid Dispersing Binder A, except that the polyvinyl alcohol was replaced with polyvinyl alcohol of a degree-of polymerization of 700 and a saponification ratio of 95 percent.

(Preparation of Dispersing Binder C)

Dispersing Binder C was prepared in the same manner as aforesaid Dispersing Binder A, except that the polyvinyl alcohol was replaced with polyvinyl alcohol of a degree of polymerization of 220 and a saponification ratio of 80 percent.

(Preparation of Dispersing Binder D)

Dispersing Binder D was prepared in the same manner as aforesaid Dispersing Binder A, except that the polyvinyl alcohol was replaced with polyvinyl alcohol of a degree of polymerization of 1,150 and a saponification ratio of 99.5 percent.

(Preparation of Dispersing Binder E)

Dispersing Binder E was prepared in the same manner as aforesaid Dispersing Binder A, except that aldehyde employed for acetalation was varied from butylaldehyde to acetaldehyde.

(Preparation of Dispersing Binder F)

Dispersing Binder F was prepared in the same manner as aforesaid Dispersing Binder A, except that the polyvinyl alcohol was replaced with polyvinyl alcohol of a degree of polymerization of 270 and a saponification ratio of 95 percent.

(Preparation of Dispersing Binder G)

Dispersing Binder G was prepared in the same manner as aforesaid Dispersing Binder A, except that the polyvinyl alcohol was replaced with polyvinyl alcohol of a degree of polymerization of 950 and a saponification ratio of 95 percent.

(Preparation of Subbed Supports)

Both sides of a biaxially oriented polyethylene terephthalate film at a blue dye density of 0.115 were subjected to corona discharge treatment under a condition of 10 $W/m^2$·minute. Subsequently, <<Back Surface Side Subbing Lower Layer Liquid Coating Composition>>, described below, was applied onto one of the surfaces to result in a dried layer thickness of 0.06 μm and dried at 140° C. Subsequently, <<Back Surface Side Subbing Upper Layer Liquid Coating Composition>> was applied to result in a dried layer thickness of 0.2 μm, and subsequently dried at 140° C. Further, <<Image Forming Surface Side Subbing Upper Layer Liquid Coating Composition>> was applied onto the reverse side surface to result in a dried layer thickness of 0.25 μm and subsequently, <<Image Forming Surface Side Subbing Upper Layer Liquid Coating Composition>>, described below, was applied onto the aforesaid coating to result in a dried layer thickness of 0.06 μm. Thereafter, the resulting coatings were dried at 140° C. The coatings prepared as above was subjected to a thermal treatment at 140° C. for two minutes, whereby a subbed support sample was prepared.

<<Back Surface Side Subbing Lower Layer Liquid Coating Composition>>

| | |
|---|---|
| Copolymerized polymer latex (solids 30 percent) of styrene/glycidyl methacrylate/butyl acrylate (20/20/40) | 16.0 g |
| Copolymerized polymer latex (solids 10 percent) of styrene/butyl acrylate/ hydroxymethyl methacrylate (25/45/30) | 4.0 g |
| $SnO_2$ sol (solids 10 percent) (synthesized by the method described in JP-A No. 10-059720) | 91 g |
| Surface Active Agent A | 0.5 g |

A liquid coating composition was prepared by adding distilled water to the above so that the total volume reached 1,000 ml.

<<Back Surface Side Subbing Upper Layer Liquid Coating Composition>>

| | |
|---|---|
| Modified Water Based Polyester A (solids 18 percent) | 215.0 g |
| Surface Active Agent A | 0.4 g |
| Spherical Silica Matting Agent Sea Hoster KE-P50 (manufactured by Nippon Shokubai Co., Ltd.) | 0.3 g |

A liquid coating composition was prepared by adding distilled water to the above so that the total volume became 1,000 ml.

<<Synthesis of Modified Water Based Polyester A>>

Charged into a condensation polymerization reaction vessel were 35.4 weight parts of dimethyl terephthalate, 33.63 weight parts of dimethyl isophthalate, 17.92 weight parts of a sodium salt of dimethyl 5-sulfo-isophthalate, 62 weight parts of ethylene glycol, 0.0065 weight part of calcium acetate monohydrate, and 0.022 weight part of manganese acetate tetrahydrate. Under a flow of nitrogen, a transesterification reaction was performed while distilling out methanol at 170–220° C. Thereafter, 0.04 weight part of trimethyl phosphate, 0.04 weight part of antimony trioxide as a condensation polymerization catalyst, and 6.8 weight parts of 4-cyclohexadicarboxylic acid were added, and the resulting mixture underwent esterification at a reaction temperature of 220–235° C. while distilling out a nearly theoretical amount of water. Thereafter, the pressure in the reaction system was further lowered over about one hour, as the temperature was raised. Subsequently, condensation polymerization was performed for about one hour at 280° C. and at most 133 Pa, whereby the precursor of Water-Based Modified Polyester A was prepared. The intrinsic viscosity of the precursor was 0.33.

Charged into a 2-liter three-necked flask fitted with stirring blades, a reflux cooling pipe, and a thermometer, was 850 ml of pure water, and 150 g of the above precursor was gradually added while rotating the stirring blades. After stirring the resulting mixture at room temperature for 30 minutes, the interior temperature was raised to 98° C. over a period of 1.5 hours, and at this temperature, dissolution was performed for 3 hours. After completion of the heating, the resulting solution was cooled to room temperature over a period of one hour and was allowed to stand over night, whereby a precursor solution at a solid concentration of 15 percent by weight was prepared.

Charged into a 3-liter four-necked flask fitted with stirring blades, a reflux cooling pipe, a thermometer, and a dripping funnel was 1,900 ml of the above precursor solution, and while rotating the stirring blades, the interior temperature was raised to 80° C. Subsequently, 6.52 ml of a 24 percent aqueous ammonium peroxide solution was added, and a monomer mixed liquid composition (comprised of 28.5 g of glycidyl methacrylate, 21.4 g of ethyl acrylate, and 21.4 g of methyl methacrylate) was dripped over a period of 30 minutes, and the reaction was allowed to continue for an additional three hours. Thereafter, the temperature was lowered to a maximum of 30° C., and filtration was performed, whereby Modified Water Based Polyester A was prepared.

<<Image Forming Surface Side Subbing Lower Layer Liquid Coating Composition>>

| | |
|---|---|
| Copolymerized polymer latex (solids 30 percent) of styrene/ acetacetoxyethyl methacrylate/glycidyl methacrylate/n-butyl acrylate (40/40/20/0.5) | 70 g |
| Surface Active Agent A | 0.3 g |

A liquid coating composition was prepared by adding distilled water to the above so that the total volume became 1,000 ml.

<<Image Forming Surface Side Subbing Upper Layer Liquid Coating Composition>>

| | |
|---|---|
| Modified Water Based Polyester B (solids 18 percent) | 80.0 g |
| Surface Active Agent A | 0.4 g |
| Spherical silica matting agent Sea Hoster KE-P50 (manufactured by Nippon Shokubai Co., Ltd.) | 0.3 g |

A liquid coating composition was prepared by adding distilled water to the above so that the total volume became 1,000 ml.

<<Synthesis of Modified Water Based Polyester B>>

A Modified Water Based Polyester B solution was prepared in the same manner as Modified Water Based Polyester A, except that the volume of the precursor solution was varied to 1,800 ml and the composition of the monomer mixed liquid composition was changed to 31 g of styrene, 31 g of acetacetoxyethyl methacrylate, 61 g of glycidyl methacrylate, and 7.6 g of n-butyl acrylate.

Surface Active Agent A

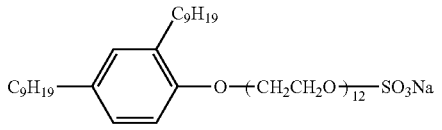

(Preparation of Silver Halide-Containing Organic Silver Emulsion for Image Forming Layer)

(Preparation of Silver Halide Emulsion A)

| | |
|---|---|
| <Solution A1> | |
| Phenylcarbamoyl gelatin | 88.3 g |
| $HO(CH_2CH_2O)_n$— $(CH(CH_3)CH_2)_{17}$— $(CH_2CH_2O)_mH$ (m + n = 5–7) (10 percent aqueous methanol solution) | 10 ml |
| Potassium bromide | 0.32 g |
| Water to make | 5429 ml |
| <Solution B1> | |
| 0.67 mol/L aqueous silver nitrate solution | 2635 ml |
| <Solution C1> | |
| Potassium bromide | 51.55 g |
| Potassium iodide | 1.47 g |
| Water to make | 660 ml |
| <Solution D1> | |
| Potassium bromide | 154.9 g |
| Potassium iodide | 4.41 g |
| Iridium chloride (1 percent solution) | 0.93 ml |
| Water to make | 1982 ml |
| <Solution E1> | |
| 0.4 mol/L aqueous potassium bromide solution silver potential controlled amount below | |
| <Solution F1> | |
| Potassium hydroxide | 0.71 g |
| <Solution G1> | |
| 56 percept aqueous acetic acid solution | 18.0 ml |
| <Solution H1> | |
| Sodium carbonate anhydride | 1.72 g |
| Water to make | 151 ml |

By employing the mixing stirrer shown in Japanese Patent Publication No. 58-58288, added to Solution A1 were a quarter of Solution B1 and all of Solution C1 employing a double-jet method over a period of 4 minutes and 45 seconds, while maintaining the temperature at 45° C. and the pAg at 8.09, whereby nuclei were formed. One minute later, all of Solution F1 was added. During the addition, the pAg was suitably controlled employing Solution E1. After 6 minutes, three quarters of Solution B1 and all of Solution D1 were added employing a double-jet method over a period of 14 minutes and 15 seconds, while maintaining the temperature at 45° C. and the pAg at 8.09. After stirring for 5 minutes, the temperature was lowered to 40° C., and all of Solution G1 was added, whereby a silver halide emulsion was subjected to sedimentation. The supernatant was removed while leaving 2,000 ml of the sediment portion. Subsequently, 10 liters of water were added, and after stirring, the resulting silver halide emulsion was again subjected to sedimentation. The supernatant was removed while leaving 1,500 ml of the sediment portion. Thereafter, Solution H1 was added, and the temperature was raised to 60° C. and stirring was performed for an additional 120 minutes. Finally, the pH was adjusted to 5.8 and water was added so that the weight per mol of silver reached 1,161 g, whereby Light-Sensitive Silver Halide Emulsion A was prepared.

The resulting emulsion was comprised of monodispersed cubic iodobromide silver grains of an average grain size of 0.041 μm, a grain size variation coefficient of 12 percent, and a ratio of [100] plane of 92 percent.

(Preparation of Organic Silver Salt Powder A)

At 80° C., dissolved in 4,720 ml of pure water were 130.8 g of behenic acid, 67.7 g of arachidic acid, 43.6 g of stearic acid, and 2.3 g of palmitic acid. Subsequently, 540.2 ml of 1.5 mol/L aqueous potassium hydroxide solution was added and then 6.9 ml of concentrated nitric acid was added. Thereafter, the temperature was lowered to 55° C., whereby a fatty acid sodium solution was prepared. While maintaining the above fatty acid sodium solution at 55° C., 45.3 g of aforesaid Light-Sensitive Silver Halide Emulsion A and 450 ml of pure water were added and stirred for 5 minutes.

Subsequently, 702.6 ml of a 1 mol/L silver nitrate solution was added over a period of two minutes and the resulting mixture was stirred for 10 minutes, whereby a organic silver salt dispersion was obtained.

Thereafter, the resulting organic silver salt dispersion was transferred to a washing vessel, and deionized water was added and then stirred. Thereafter, the resulting mixture was allowed to stand so that the organic silver salt dispersion floated to the top and separated, and water-soluble salts settled on the bottom were removed. Thereafter, washing and draining were repeated until the electric conductivity of the drain reached 2 μS/cm, and centrifugal dehydration was performed. Thereafter, the resulting cake-shaped organic silver salt was dried until the moisture content reached 0.1 percent, employing a flash dryer, Flash Jet Drier (manufactured by Seishin Enterprise Co., Ltd.) by controlling the nitrogen gas ambience and hot air temperature at the inlet of the dryer, whereby dried Organic Silver Salt Powder A was trapped as an organic silver salt. Incidentally, the moisture content of organic silver salt composition was determined employing an infrared ray moisture meter.

(Preparation of Organic Silver Salt Powder B)

Organic Silver Salt Powder B was prepared in the same manner as Organic Silver Salt Powder A, except that the aqueous potassium hydroxide solution was replaced with an aqueous sodium hydroxide solution.

(Preparation of Organic Silver Salt Dispersion)

Examples 1–4 and Comparative Examples 1–5

Dissolved in 1,300 g of methyl ethyl ketone was 26 g of the dispersing binder described in Table 1. Subsequently, while stirring, employing Dissolver DISPERMAT Type CA-40M, manufactured by VMA-GETZMANN Co., 500 g of Organic Silver Salt Powder A was gradually added and sufficiently mixed, whereby a preliminary dispersion was prepared. After adding all Organic Silver Salt Powder A, stirring was carried out at 2,000 rpm for 30 minutes. The resulting preliminary dispersion was fed to a media type homogenizer DISPERMAT Type SL-C12EX (manufactured by VMA-GETZMANN Co.) packed with diameter 5 mm zirconia beads (Toraycerum, manufactured by Toray Industries, Inc.) at an interior volume of 80 percent, employing a pump so that retention time in the mill was 1.5 minutes, and dispersion was performed at a mill peripheral rate of 8 m/second, whereby an organic silver salt dispersions was prepared. The concentration of the dispersing binders in the organic silver salt dispersion was 1.4 percent.

Comparative Example 6

An organic silver dispersion was prepared in the same manner as Example 1, except that in this dispersion raw material liquid composition, the weight of the dispersing binder described in Table 1 was increased to 182 g. The concentration of the dispersing binder in the organic silver salt dispersion was 9.3 percent.

Comparative Example 7

An organic silver dispersion was prepared in the same manner as Example 1, except that in this dispersion raw material liquid composition, the weight of the dispersing binder described in Table 1 was decreased to 7.8 g. Since during preparation of the preliminary dispersion, it became impossible to perform stirring, it was not possible to carry out the main dispersion.

(Coating of Image Forming Layer and Back Layer)

A back layer was applied onto the subbing on the back layer side of the aforesaid subbed sample and once wound. Subsequently, an image forming layer and a protective layer were subjected to double coating on the subbing on the image forming layer side opposite the back layer side. Each coating was dried at 60° C. for 15 minutes. The double side coated sample was subjected to thermal treatment at 75° C. for 10 minutes, whereby a photothermographic material was prepared.

<<Back Layer>>

| | |
|---|---|
| Cellulose acetate butyrate (10 percent methyl ethyl ketone solution) | 15 ml/m$^2$ |
| Dye-A | 7 mg/m$^2$ |
| Dye-B | 7 mg/m$^2$ |
| Matting agent: monodipsersed silica of a degree of monodispersion of 15 percent and an average particle | 90 mg/m$^2$ |

-continued

| | |
|---|---|
| size of 14 μm | |
| $C_8F_{17}(CH_2CH_2O)_{12}C_8F_{17}$ | 50 mg/m$^2$ |
| $C_9F_{17}$—$C_6H_4$—$SO_3Na$ | 10 mg/m$^2$ |

Dye-A

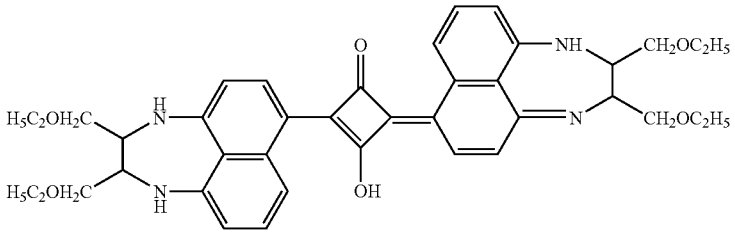

Dye-B

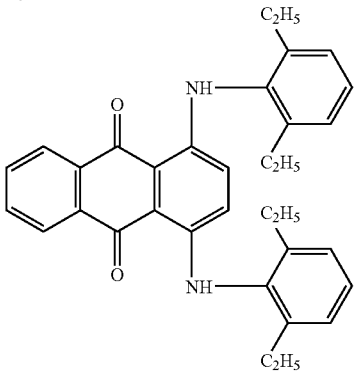

<<Image Forming Layer (Light-Sensitive Layer)>>

Added to 425 g of the organic silver dispersion prepared as above were the following coating binder and components. Subsequently, methyl ethyl ketone was added to prepare an image forming layer liquid coating composition which was coated to result in a coated silver weight of 1.9 g/m$^2$.

Coating binder (polyvinyl butyral) Butvar B-79 (manufactured by Monsanto Co.) amount described in Table 1

| | |
|---|---|
| Sensitizing dye (0.03 percent MEK solution) | 40 ml |
| Bis (dimethylacetamido)dibromobromate (11 percent methanol solution) | 2.6 ml |
| Calcium bromide (11 percent methanol solution) | 4.2 ml |
| Tetrachlorophthalic acid (11 percent MEK solution) | 16 ml |
| 2-Mercaptobenzimidazole (11 percent methanol solution) | 16 ml |
| Desmodur N3300 (aliphatic isocyanate, manufactured by Mobay Co.) | 4.5 g |
| Tribromomethylsulfonylpyridine (5 percent MEK solution) | 29.5 ml |
| Developing agent: 1,1-bis (2-hydroxy-3,5-dimethylphenyl-2-methylpropane (20 percent methanol solution) | 29.5 ml |

Sensitizng Dye

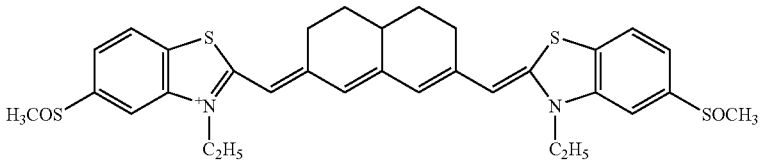

Antifoggant

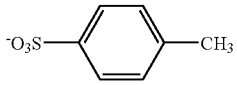

-continued

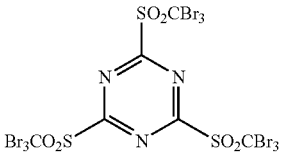

<<Image Forming Layer Protecting Layer>>

| | |
|---|---|
| Acetone | 5 ml/m$^2$ |
| Methyl ethyl ketone | 21 ml/m$^2$ |
| Cellulose acetate butyrate | 2.3 g/m$^2$ |
| Methanol | 7 ml/m$^2$ |
| Phthalazine | 250 mg/m$^2$ |
| Matting agent: monodipsersed silica of a degree of monodispersion of 10 percent and an average particle size of 4 μm | 5 mg/m$^2$ |
| Antifoggant: $CH_2{=}CHSO_2CH_2CH_2OCH_2CH_2SO_2CH{=}CH_2$ | 35 mg/m$^2$ |
| Fluorine based surface active agent | |
| $C_{12}F_{25}(CH_2CH_2O)_{10}C_{12}F_{25}$ | 10 mg/m$^2$ |
| $C_8F_{17}{-}C_6H_4{-}SO_3Na$ | 10 mg/m$^2$ |

Table 1 shows the evaluation results of the average particle diameter of organic silver salt particles in the organic silver salt dispersions prepared as above, as well as the visually evaluated coatability of the image forming layer, density (fog density) of the minimum density portion, density of the maximum density portion of photothermographic materials.

Based on Table 1, it is to be noted that the average particle diameter of the organic silver salt dispersion prepared employing the sodium soap of organic acid was smaller than that prepared employing the sodium soap. Further, when the degree of polymerization, the water content contained in the dispersing binder and organic silver, the ratio of the dispersing binding to the coating binder are within the range specified in the present invention, it is found that it is possible to prepare a photothermographic material which exhibits excellent coatability, low fog density, and high maximum density.

TABLE 1

| Example or Comparative Example | Type of Organic Silver | Dispersing Binder Type | Dispersing Binder Degree of Polymerization | Binder Weight Ratio Dispersing Binder/ Coating Binder | Moisture Content A (%) + B (%) | Dispersion Number Average Particle Diameter (nm) | Photographic Performance Coatability | Photographic Performance Fog Density | Photographic Performance Maximum Density |
|---|---|---|---|---|---|---|---|---|---|
| Example 1 | A | A | 500 | 1/20 | 3.5 | 373 | good | 0.170 | 4.25 |
| Comparative Example 1 | B | A | 500 | 1/20 | 3.5 | 643 | good | 0.173 | 3.83 |
| Example 2 | A | B | 700 | 1/20 | 3.1 | 366 | good | 0.171 | 4.28 |
| Comparative Example 2 | B | B | 700 | 1/20 | 3.1 | 655 | good | 0.174 | 3.75 |
| Comparative Example 3 | A | C | 220 | 1/20 | 5.5 | 428 | good | 0.211 | 3.77 |
| Comparative Example 4 | A | D | 1150 | 1/20 | 2.7 | 452 | good | 0.235 | 3.65 |
| Comparative Example 5 | A | E | 500 | 1/20 | 5.3 | 420 | good | 0.198 | 3.52 |
| Comparative Example 6 | A | A | 500 | 1/3 | 3.5 | 750 | poor | 0.188 | 3.15 |
| Comparative Example 7 | A | A | 500 | 1/70 | 3.5 | — | impossible to achieve main dispersion | | |
| Example 3 | A | F | 270 | 1/20 | 3.5 | 380 | good | 0.172 | 4.25 |
| Example 4 | A | G | 950 | 1/20 | 3.5 | 377 | good | 0.182 | 4.22 |

What is claimed is:

1. A method of producing an organic silver salt dispersion comprising the step of:

dispersing a mixture of:

light-insensitive organic silver salt grains;

photosensitive silver halide grains;

a solvent; and a binder for dispersion, wherein the organic silver salt is prepared by using:

(i) an alkaline metal salt of an organic acid other than a sodium salt; and (ii) a water soluble silver compound, and the binder is a polyvinyl acetal resin having a polymerization degree of 250 to 1000 and prepared by acetal forming reaction of a polyvinylalcohol with an aldehyde.

2. A method of producing an organic silver salt dispersion comprising the step of:

dispersing a mixture of:

light-insensitive organic silver salt grains;

photosensitive silver halide grains;

a solvent; and a binder for dispersion, wherein an average particle diameter of the organic silver salt grains is 50 to 600 nm; and the binder is a polyvinyl acetal resin having a polymerization degree of 250 to 1000 and prepared by acetal forming reaction of a polyvinylalcohol with an aldehyde.

3. The method of producing an organic silver salt dispersion of claim 1, wherein an average particle diameter of the organic silver salt grains is 50 to 600 nm.

4. The method of producing an organic silver salt dispersion of claim 1, wherein the alkaline metal salt of the organic acid used to prepare the organic silver salt is a potassium salt.

5. The method of producing an organic silver salt dispersion of claim 1, wherein a water content. A (%) in the light-insensitive organic silver salt grains and a water content B (%) in the binder for dispersion satisfy the formula:

$$0.05 \leqq A+B \leqq 5.$$

6. A method of producing a photothermographic material, comprising the step of:

coating the organic silver salt dispersion produced by the method of claim 5 with an additional amount of the binder on the support to obtain the photosensitive layer; and drying the coated photosensitive layer.

7. A method of producing a photothermographic material, comprising the step of:

coating the organic silver salt dispersion produced by the method of claim 6 with an additional amount of the binder on the support to obtain the photosensitive layer; and drying the coated photosensitive layer.

8. The method of producing a photothermographic material of claim 6, wherein an amount of the binder for dispersion is 1/50 to 1/5 of a total weight of the binder in the photosensitive layer.

9. The method of producing a photothermographic material of claim 7, wherein an amount of the binder for dispersion is 1/50 to 1/5 of a total weight of the binder in the photosensitive layer.

* * * * *